US012203285B2

(12) United States Patent
Burt et al.

(10) Patent No.: US 12,203,285 B2
(45) Date of Patent: Jan. 21, 2025

(54) USER ASSEMBLABLE PICKET RAIL PANEL

(71) Applicant: Fortress Iron, LP, Garland, TX (US)

(72) Inventors: Kevin Burt, Dallas, TX (US); Collin Robinson, Garland, TX (US); Kevin Flatt, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 425 days.

(21) Appl. No.: 17/744,281

(22) Filed: May 13, 2022

(65) Prior Publication Data

US 2023/0366236 A1 Nov. 16, 2023

(51) Int. Cl.
*E04H 17/14* (2006.01)

(52) U.S. Cl.
CPC ..... *E04H 17/1439* (2013.01); *E04H 17/1447* (2021.01)

(58) Field of Classification Search
CPC . E04H 17/24; E04H 17/1417; E04H 17/1447; E04H 17/1439; E04F 2011/1819; E04F 2011/1821; E04F 11/1842; E04F 11/1859; E04F 11/1817; F16G 11/12
See application file for complete search history.

(56) References Cited

U.S. PATENT DOCUMENTS 3,323,781 A * 6/1967 Murdock ..... E04F 11/181 403/255
3,962,774 A 6/1976 Noro et al.
9,790,707 B2 * 10/2017 Burt ..... E04H 17/24
9,976,320 B2 * 5/2018 Burt ..... E04F 11/1859
11,300,180 B2 * 4/2022 Graber ..... F16G 11/12
2014/0021423 A1 * 1/2014 Zen ..... E04F 11/1817 256/65.13
2015/0252570 A1 * 9/2015 Springborn ..... E04H 17/1417 52/832
2015/0292233 A1 * 10/2015 Burt ..... E04F 11/1859 256/48

(Continued)

OTHER PUBLICATIONS

International Search Report and Written Opinion dated Jul. 27, 2023 in PCT/US2023/021144; pp. 14.

*Primary Examiner* — Daniel J Wiley
(74) *Attorney, Agent, or Firm* — Foley & Lardner LLP; John J. May

(57) ABSTRACT

A user assemblable picket rail panel includes a top rail with a transverse wall, a first side wall and a second side wall each extending from the transverse wall with a plurality of openings disposed spaced apart along a length of the transverse wall. The top rail further includes a first locking ledge extending from a first side wall and a second locking ledge extending from the second side wall. A picket plug is configured to be secured to the top rail by the first and second locking ledges and has a picket-insertable portion that is configured to be aligned with one of the plurality of openings in the transverse wall. The picket plug defines a through hole that is configured to receive a fastener. The rail panel also includes a support picket that is configured to receive the picket-insertable portion of the picket plug and includes a threaded hole that is configured to receive the fastener. A bottom rail is configured to be coupled to the support picket, and the rail panel also includes a plurality of infill pickets that are configured to be coupled to the top rail and the bottom rail.

20 Claims, 13 Drawing Sheets

(56) References Cited

U.S. PATENT DOCUMENTS

| | | | | |
|---|---|---|---|---|
| 2017/0234015 | A1* | 8/2017 | Bizzarri | E04F 11/1836<br>256/22 |
| 2020/0080620 | A1* | 3/2020 | Graber | E04F 11/1842 |
| 2021/0222436 | A1* | 7/2021 | Burt | E04F 11/1817 |

* cited by examiner

USER ASSEMBLABLE PICKET RAIL PANEL

TECHNICAL FIELD

The present disclosure relates to construction materials, and more particularly to a knock-down picket rail panel that is assemblable and disassemblable by a user or installer.

BACKGROUND

Rail panel systems generally are often installed by a professional contractor. They may be delivered to a job site fully assembled. Alternatively, rail panel systems may be delivered disassembled and the contractor may assemble the rail panel in connection with their installation. It is common for assembled rail panels to be cut to fit a particular length of a deck, platform or stairway on which the rail panels are installed. Fully assembled rail panels that are not easily disassembled and reassembled may be more difficult to be cut down to a size that fits a particular spacing between support posts. For example, the full rail panel will be supported during cutting down a welded rail panel to fit a spacing between support posts that is smaller than the length of the rail panel.

SUMMARY OF THE INVENTION

According to an embodiment, a rail panel can have a channel member having a bottom wall, the bottom wall defining a plurality of through holes that are configured to receive a picket, a pair of lateral side walls extend from the bottom wall, and a pair of locking walls extending inwardly from the pair of lateral side walls. The rail panel includes a picket with an end with an internal profile that is configured to receive the picket plug and an external profile configured to be received by the plurality of through holes. The rail panel may also have a picket plug having a first end configured to be received by the internal profile of the end of the picket and a second end configured such that the picket plug is secured within the channel member by the pair of locking walls in a first orientation and can be removed from the channel member in a second orientation.

According to another embodiment, a rail panel may be configured such that the picket plug is rotated 90 degrees from the first orientation to the second orientation.

According to yet another embodiment, a rail panel may be configured such that the picket also includes a threaded insert disposed within the picket that configured to receive a fastener.

According to other embodiments, a rail panel may be configured such that the picket plug is configured to receive the fastener.

According to another embodiment, a rail panel may also include a cover channel member configured to interface with the channel member.

According to other embodiments, a rail panel may be configured such that the picket plug also has at least one channel formed in the first end of the picket plug and the internal profile also has at least one inwardly extending wall, wherein the channel is configured to interface with the inwardly extending wall are.

According to another embodiment, a rail panel may also include a support member configured such that the support member is configured to be secured within the channel member by the pair of locking walls in a first orientation and can be removed from the channel member in a second orientation.

According to yet another embodiment, components of the rail panel including the top and bottom rails and the pickets are formed by extruding aluminum.

According to another embodiment, a method of assembling a knock-down rail panel from a kit may include the steps of providing a first and second channel. Each channel having a transverse wall, a pair of leg members extending from the transverse wall, and a pair of locking members extending inwardly from the pair of first leg members. The transverse wall defines a plurality of spaced apart through holes. Another step may be providing a picket. Wherein the picket is configured to be received by at least one of the spaced apart through holes. Another step may be providing a picket plug configured to interlock with the pair of locking members and couple to an end of the picket.

Technical advantages of the disclosed embodiments include a rail panel that may be shipped in packaging configured to contain a disassembled rail panel that is assemblable by the user/installer. The rail panel may include features to facilitate assembly that are formed during an extrusion process.

BRIEF DESCRIPTION OF THE DRAWINGS

The disclosure will become more fully understood from the following detailed description, taken in conjunction with the accompanying figures, wherein like reference numerals refer to like elements, in which.

The drawings are not necessarily to scale and certain features may be shown exaggerated in scale or in somewhat schematic form in the interest of clarity and conciseness.

DETAILED DESCRIPTION

Embodiments disclosed herein provide a system, an apparatus, and a method for a user assemblable rail panel system 100. In particular, embodiments disclosed herein provide a rail panel system 100 that can be easily assembled and disassembled. Thus, the user assemblable rail system 100 may be provided to a user either as an assembled panel or in discrete components. In installing the rail panel 100 on a deck of a user, the rail panel may be easily disassembled and reassembled to allow for cutting down the panel to fit a particular spacing between posts. The selection and mix of different components, the ratio of standard pickets 16 to support pickets 14 can be made to fit the application needs or preferences of the end user.

Figure 1:
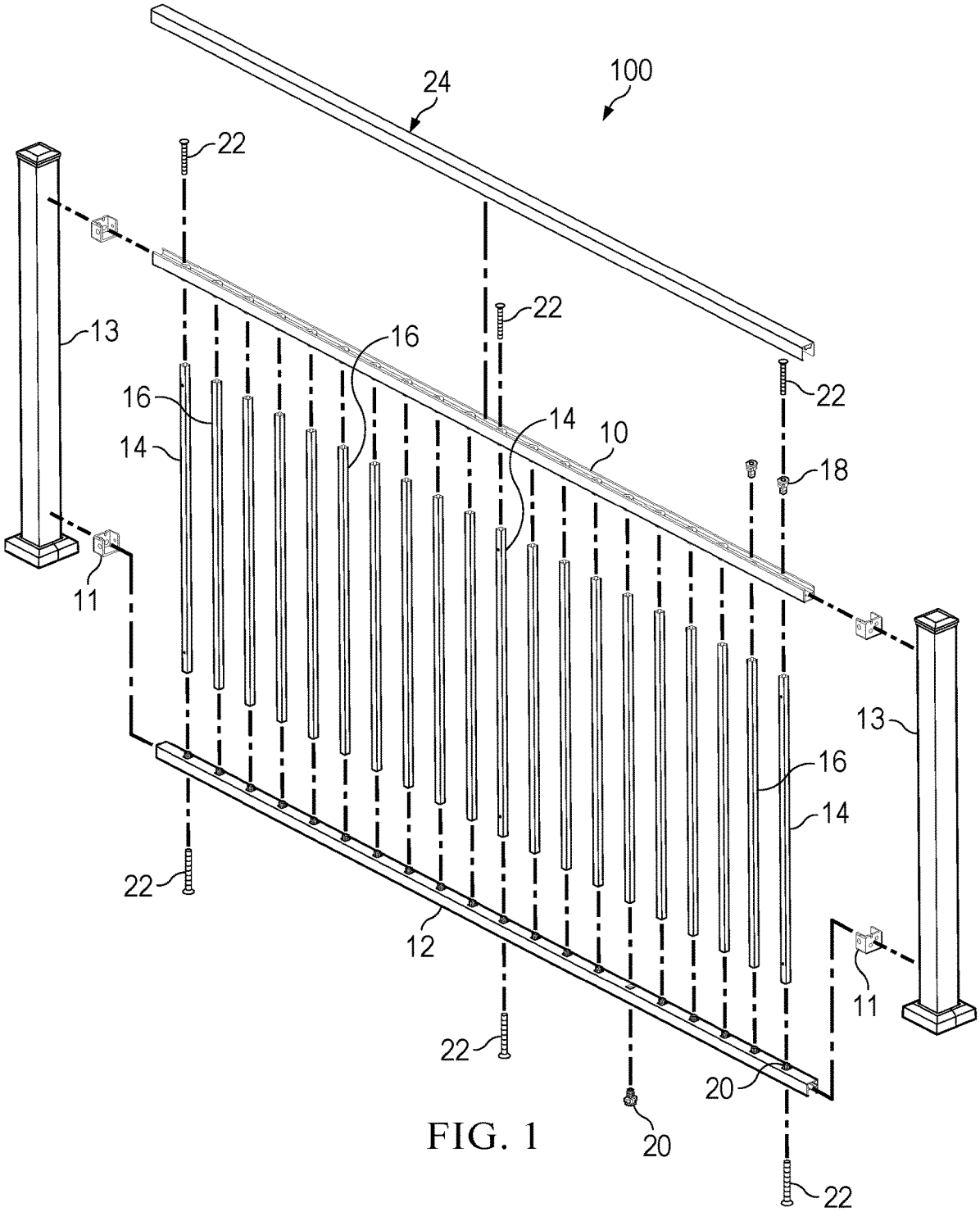
FIG. 1 is an exploded, perspective view of a user assemblable rail panel system according to an embodiment of the present disclosure.

Referring to FIG. 1, which illustrates an exploded perspective of an embodiment of a user assemblable rail panel system 100. The present embodiment includes a top rail member 10, a bottom rail member 12, a plurality of support pickets 14, a plurality of standard pickets 16, a plurality of top picket plugs 18, and a plurality of bottom picket plugs 20. The present embodiment also includes a plurality of fasteners 22 that secure the top rail 10 to the support pickets 14 and the bottom rail 12 to the support pickets 14. According to certain embodiments, the user assemblable rail panel 100 may also include a rail cap 24 that is fitted to the top rail 10 and conceals the hardware internal to the top rail 10 from view. A rail cap 24 may be likewise fitted to the bottom rail 12, however because the rail panel 100 is unlikely to be viewed from below the installed panel, a rail cap 24 fitted to the bottom rail 12 may be omitted.

In some embodiments, the user assemblable rail panel 100 can be installed between a pair of posts 13 disposed at each end of the rail panel 100. Alternatively, the rail panel 100 may be supported at one or both ends by a structure such as an outside wall of a home. Brackets 11 may be secured to a face of one of the posts 13 in positions to support the top rail 10 and the bottom rail 12, as shown. The brackets 11 may be U-shaped such that the top rail 10 and the bottom rail 12 is supported by a bottom wall of the U-shaped bracket and fasteners may be received through either one or both of the side walls to secure the top rail 10 and the bottom rail 12 to the bracket 11. Fasteners may be received through the back wall of the bracket and into the post 13 to secure the bracket 11 to the post 13.

The embodiment shown in FIG. 1 shows a level rail panel 100. User assemblable rail panels 100 are installed between spaced apart support posts 13 around a perimeter of a deck to create a comfortable environment for a homeowner to enjoy outdoor living. A stair panel may be installed between and upper post and a lower post to follow a stairway. The stair panel may include a preassembled stair rail panel with pickets that are pivotally connected to the top and bottom rails in order to rake or rack such that the pickets are vertical while the top and bottom rails are angled to follow the slope of a stairway. In the stair embodiment, the stair rail panel may be supported by hinged brackets secured to the upper and lower support posts of a stairway.

The infill of the rail panel 100 may include any suitable number of support pickets 14 and standard pickets 16. For example, the rail panel 100 shown in FIG. 1 includes twenty pickets, seventeen standard pickets 16 and three support pickets 14. The support pickets 14 are located proximate each end of the rail panel 100 and approximately at a mid-point between each end. According to an embodiment, positioning support pickets 16 as the closest picket to the support post and at the mid-point of the panel creates a suitably strong rail panel 100. Because a support picket 14 is interchangeable with a standard picket 16, an installer may cut down the top rail 10 and the bottom rail 12 to fit a spacing between two support posts 13 and reassemble the rail panel 100 to have support pickets 14 adjacent each support post 13 and at a midpoint of the rails. Without the support pickets 14 and the standard pickets 16 being interchangeable, cutting down a length of a rail panel may remove a support picket 14 and cause another support picket 14 to be located other than at the midpoint of the rail panel 100.

A rail panel 100 with less than three or more than three support pickets 14 is contemplated by this disclosure. For example, the user assemblable rail panel 100 may include an infill of only support pickets 14 (e.g. twenty) without the use of standard pickets 16. The rail panel system 100 can be manufactured in any suitable length. For example, the rail panel system 100 may be manufactured in approximately six foot or eight foot lengths.

Figure 2A:
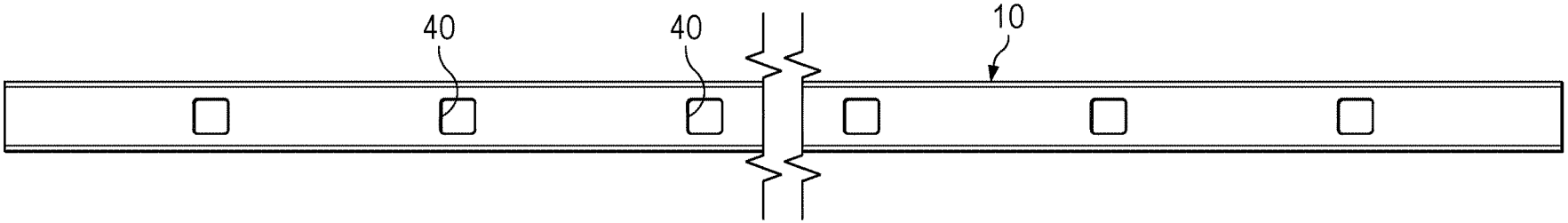
FIGS. 2A and 2B are an overhead, plan view and an end respectively of a rail member.
Figure 2B:
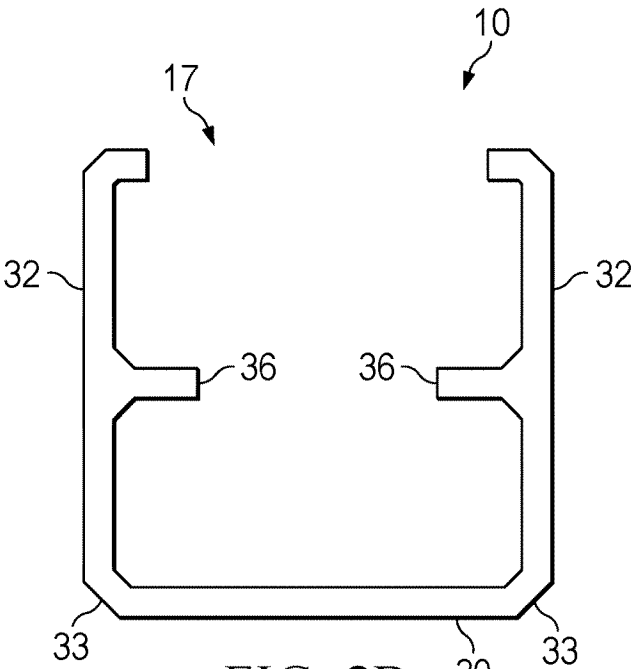

Referring now to FIGS. 2A and 2B, which respectively illustrate an overhead, plan view and an end view of an embodiment of the top rail member 10. The bottom rail member 12 includes similar features, so the description of the top rail 10 serves to describe the bottom rail 12. According to an embodiment, the top rail 10 may be slightly smaller dimensionally than the bottom rail 12. The slightly smaller dimensions of the top rail 10 corresponds to the size increase created by the rail cap 24 when it is positioned on the top rail 10, as described in further detail below. With the combination top rail 10 and rail cap 24 being the same size as the bottom rail 12, the same size brackets 11 may be used to secure the top rail 10 and the bottom rail 12 to the support posts 13. Alternatively, the top rail 10 may be the same size as the bottom rail 12. The top rail member is oriented such that a bottom wall is disposed below an open channel 17 that is oriented to face upward toward the sky. The bottom rail 12 is assembled in the panel 100 with the open channel 17 rotated 180 degrees about the longitudinal axis of the rail such that the open channel 17 faces downward toward the ground when the panel is installed.

Each of the top rail member 10 and the bottom rail member 12 includes a transverse wall 30, a pair of side walls 32 extending from the transverse wall 30, and a pair of locking ledges 36 extending inwardly from each of the side walls 32. In this embodiment, the transverse wall 30 also includes a plurality of clearance openings 40 through the transverse wall 30. The clearance openings 40 are spaced apart along the length of the transverse wall 30. Each clearance opening is configured to receive a portion of a picket plug, for example the top picket plug 18 or the bottom picket plug 20.

Each of the top rail 10 and the bottom rail 12 can be manufactured using metallic materials including, but not limited to, aluminum, iron, carbon steel, or stainless steel. In other embodiments, the rail members 10, 12 can be manufactured using an extrudable composite material that includes a wood-type filler. According to another embodiment, the rail members 10, 12 can be manufactured using plastic materials including, but not limited to, Acrylic or Polymethyl Methacrylate ("PMMA"), Polycarbonate ("PC"), Polyethylene ("PE"), Polypropylene ("PP"), Polyethylene Terephthalate ("PET"), Polyvinyl Chloride ("PVC"), or Acrylonitrile-Butadiene-Styrene ("ABS").

According to an embodiment, the standard picket 16, support picket 14, top rail member 10, bottom rail member 12, and rail cap 24, are all aluminum extrusions. Aluminum extrusions form a strong, durable, yet light weight rail panel system 100.

Figure 3A:
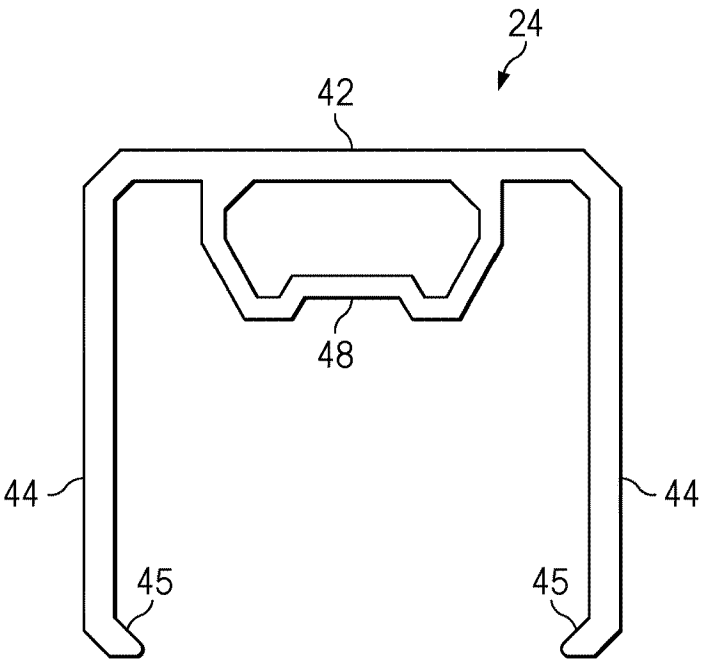
FIG. 3A is an end view of a rail cap and FIG. 3B is a partially exploded, perspective view of the assembly of the rail cap with the top rail of the rail panel system of FIG. 1.
Figure 3B:
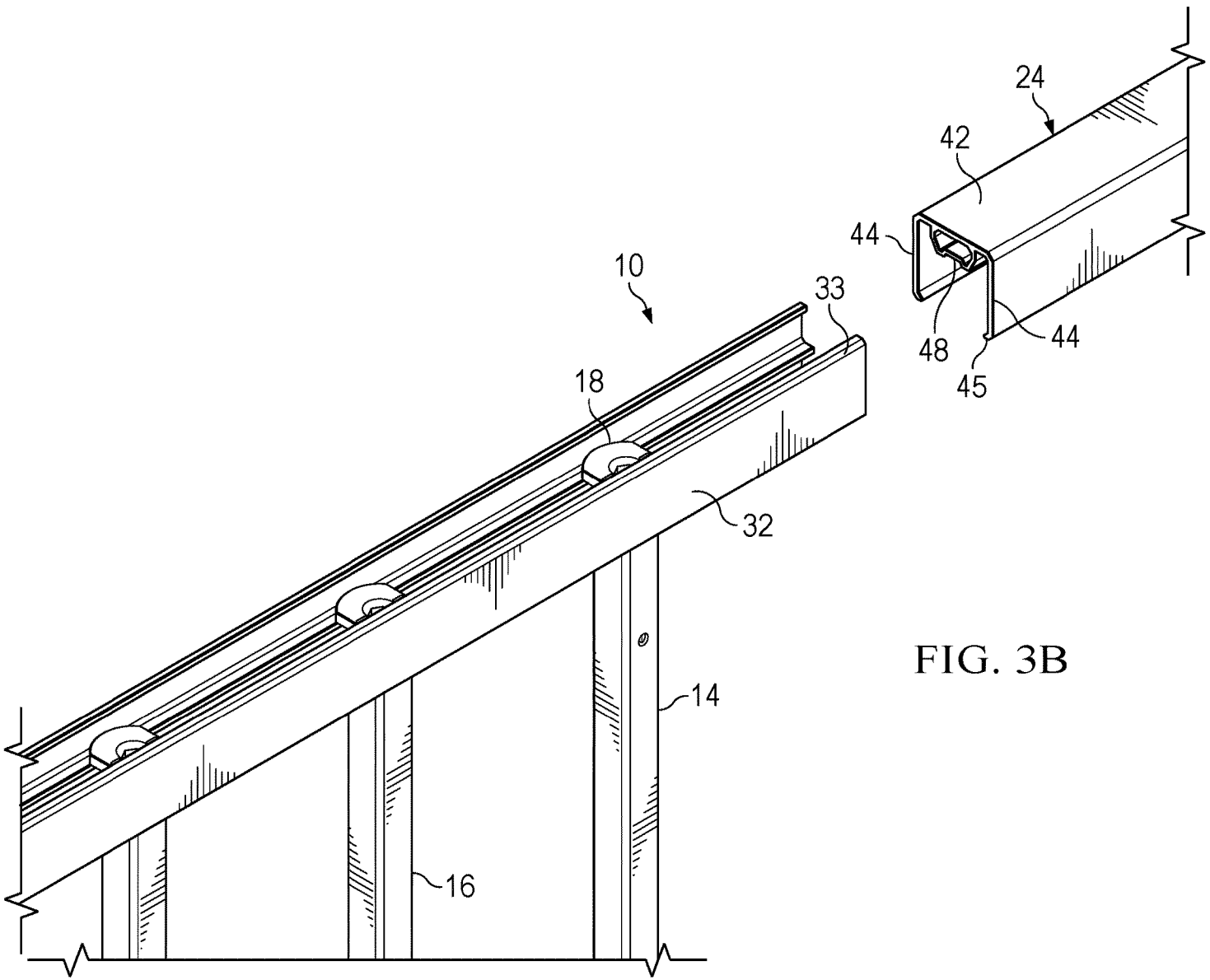

Referring now to FIGS. 3A and 3B. FIG. 3A is an end view of the rail cap 24 shown in FIG. 1. FIG. 3B is a perspective view of a portion of the rail cap 24 in position to be slid over the top rail 10. The rail cap 24 can be used to cover an exposed section of a bottom rail 12 or a top rail 10. Specifically, the rail cap 24 may be received over the top rail 10 to close the open channel 17 and conceal the picket plugs 18 and the fasteners 22 disposed within the open channel 17. In one embodiment, the rail cap 24 includes a top wall 42, a pair of side walls 44 extending from the top wall 42, and an inner profile 48 extending the length of the rail cap 24. The inner profile 48 may be extruded with the original fabrication of the rail cap 24. The inner profile 48 is sized and shaped to be received between the side walls 32 of the top rail 10, as shown in FIG. 7C. The inner profile 48 also provides clearance for the picket plugs 18. When the rail cap 24 is installed on the top rail 10, the inner profile 48 adds strength to the top rail 10. According to an embodiment, if a lateral force is applied to the assembly of the rail cap 24 and the top rail 10, the engagement of the side walls 32 with the inner profile 48 hinder further deflection of the top rail 10.

Alternatively, the inner profile 48 may be omitted, for example if the rail cap 24 is assembled to the bottom rail 12, which is less likely to receive a sudden lateral force. In this embodiment, the rail cap 24 is used as a covering for the open or exposed channel 17 of the top rail 10.

The inner profile 48 of a rail cap 24 can have a square, rectangular, circular, oval, hexagonal, octagonal, or any other profile such that the rail cap 24 can interface with a top or bottom rail 10, 12. The inner profile 48 of the rail cap 24 can add structural rigidity to the rail cap 24. In some embodiments the rail cap 24 may not have an inner profile 48.

In various embodiments, the rail cap 24 is made of like material as the rail member 10, that it can be affixed to, such as extruded aluminum. In other embodiments, the rail cap 24 is made of a material that is different from the material of the rail member 10 to which it is secured. For example, the top rail member 10 may be formed of extruded aluminum and the rail cap 24 may be formed from an extruded polymeric material.

In other embodiments, a rail cap 24 is secured to both the top rail member 10 and the bottom rail member 12. In other embodiments, a single rail cap 24 is secured to either the top rail member 10 or the bottom rail member 12, for example the top rail member 10.

According to the embodiment illustrated by FIGS. 3A and 3B, the rail cap 24 can be affixed to a rail member 10, by sliding the rail cap 24 over the end of the rail member 10. The rail cap 24 includes a pair of inward extending ledges 45 disposed at the end of each of the side walls 44. The ledges 45 engage the edges 33 of the top rail 10. The edges 33 of the top rail 10 and the bottom rail 12 may be a chamfer at the junction of the side wall 32 with the transverse wall 30. The angle of the chamfer of edges 33 correspond to an angle the ledges 45 extend from the side walls 44 of the rail cap 24. This interface holds the rail cap 24 from being lifted vertically off of the top rail 10. The rail cap 24 and the top rail 10 may be dimensioned such that the top rail 10 frictionally engages the rail cap 24. In other embodiments, a snap fit assembly, a fastener, or any other suitable assembly method, can affix rail cap 24 to rail member 10. One or more fasteners may be used to join the top rail 10 and the rail cap 24 more securely. In sliding the rail cap 24 over the top rail 10 the profile 48 is received between the side walls 32 and within the channel 17 of the top rail 10. Alternatively, the rail cap 24 may be snapped into place over the top rail 10.

Figure 4A:
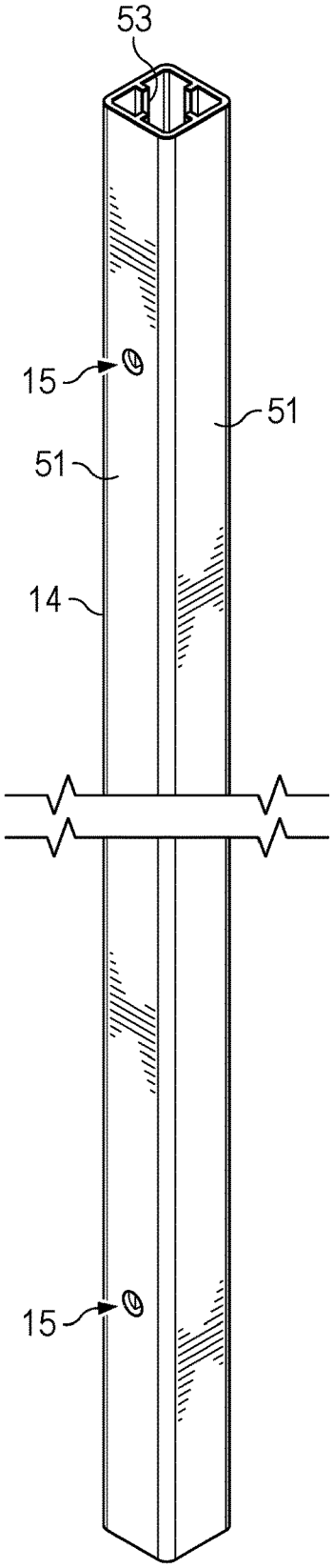
FIGS. 4A-4C respectively are perspective, cross-sectional, and end views of a support picket.
Figure 4B:
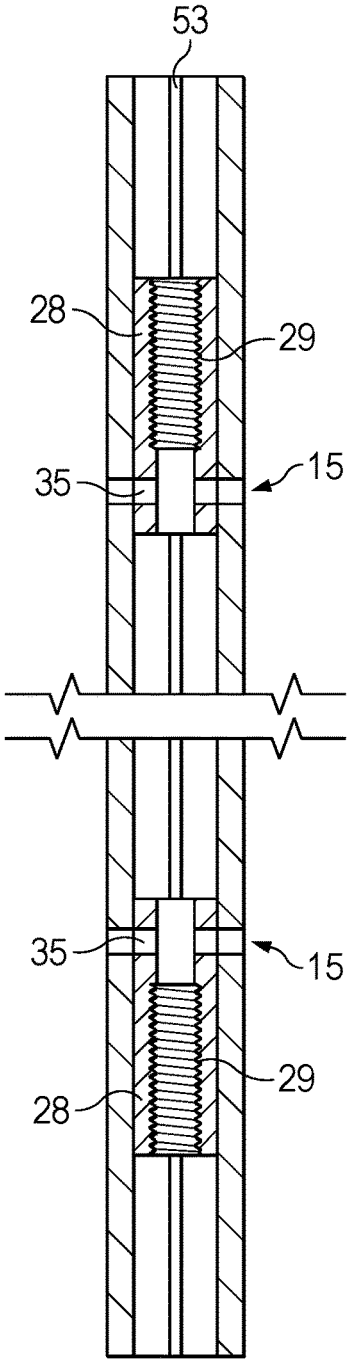
Figure 4C:
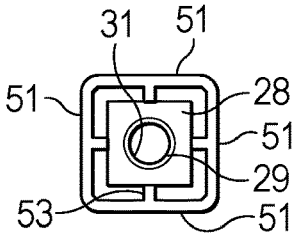

Reference is now made to FIGS. 4A, 4B, and 4C which respectively illustrate a perspective view, a cross sectional view, and a top view of an embodiment of a support picket 14. The support picket 14 may be formed by extruding a metallic material, such as aluminum, into the profile shown. In an embodiment, the support picket 14 is a generally square, tube-shaped elongated, hollow bar. Four side walls 51 form the tube shape with rounded, or alternatively chamfered, edges. An inwardly extending wall 53 extends perpendicularly a short distance inward from each side wall 51 and runs the length of the support picket 14. According to an embodiment, a length of aluminum is extruded to have the profile shown, and the overall extruded length is cut to a shorter length corresponding to the length of the support pickets 16. According to an embodiment, the support picket 14 may be approximately thirty inches in length. Alternatively, the length of the support picket 14 and the standard picket may be in a range of twenty-five inches to forty-five inches. Any suitable length of the support picket 14 and the standard picket 16 is contemplated by this disclosure. Secondary features, such as through holes 15 may be drilled into one or more of the side walls 51 of the support picket 14.

The support picket 14 adds rigidity and strength to the rail panel 100. The cross sectional view of support picket 14 illustrated in FIG. 4B shows threaded members 28 secured within a top end and a bottom end of the support picket 14. Alternatively, the threaded member 28 may be secured in only the top end or only the bottom end. The threaded member 28 is sized to be snugly received between the inwardly extending walls 53. Alternatively, the threaded member 28 may have channels formed in one or more of its outer surfaces to receive the inwardly extending walls 53. The threaded member 28 includes female threads 29 and either a blind hole or a through hole 31.

The threaded member 28 also includes a transverse through hole 35 that is sized to receive a pin to secure the threaded member 28 at a predetermined depth within the support picket 14. When the threaded member 28 is positioned in the support picket 14, the through hole 35 is aligned with a hole 15 in one or more of the walls of the support picket 14. The through hole 35 is aligned with the through hole 15 to receive a pin to secure the threaded member 28 at the proper depth within the support picket 14. The depth of the threaded insert 28 may be selected to allow the insertable portion of the picket plug 20 to be received between the threaded insert 28 and the end of the support picket 14. The pin (not shown) may be welded, ground and powder coated, such that the welded pin does not show in the finished support picket 14. Alternatively, the transverse through hole 35 may be omitted and the threaded insert/member 28 may be welded in position through the through hole 35.

The threaded member 28 allows the support picket 14 to receive fasteners 22 to secure the support picket 14 to the top rail 10 and the bottom rail 12. In this manner, the support picket 14 adds rigidity and strength to the panel 100. As discussed in further detail below, the support picket 14 receives a portion of the picket plug 20 and also the fastener 22 that extends through the picket plug 20 and is received in threaded engagement with the female threads 29 of the threaded insert 28. The support picket 14 serves to secure the top rail 10 to the bottom rail 12 and thereby hold the panel together and secure the standard pickets 16 in position as the infill of the rail panel 100. In some embodiments, only a single support picket 14 is used with the rail panel system 100 while in other embodiments a plurality of support pickets 14, for example three support pickets 14 are positioned nearest each of the pair of support posts and at a midpoint of the rail panel 100.

Figure 5A:
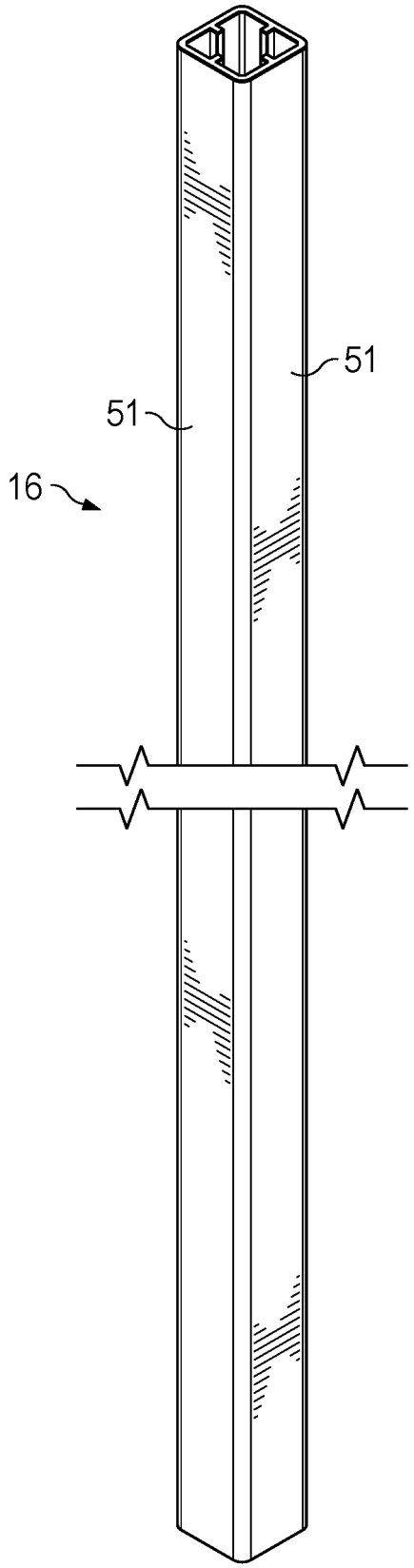
FIGS. 5A and 5B respectively are perspective and end views of a standard picket.
Figure 5B:
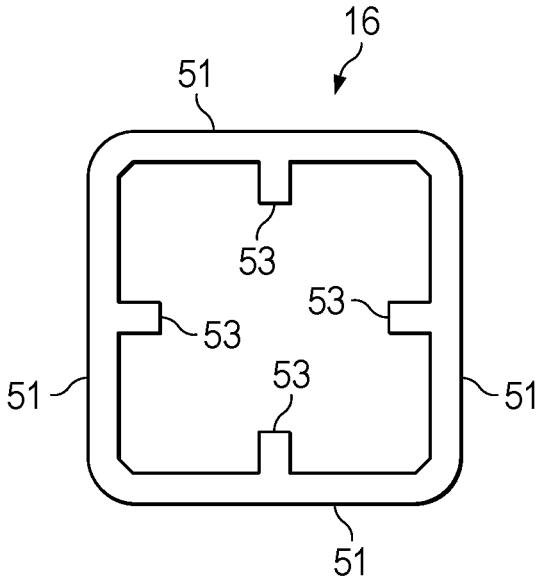

Reference is now made to FIGS. 5A and 5B, which respectively illustrates a perspective view and a top view of an embodiment of a standard picket 16. The standard picket 16 includes the inward extending walls 53 that are configured to engage with corresponding channels 63 of a picket plug 20 (see FIGS. 6A and 6C). The walls 53 of the standard picket 16 may extend the length of the picket or they may only extend along a portion of the picket. The walls 53 aid an installer with aligning the picket plugs 18, 20 to a consistent orientations and also prevent possible unintended rotation of the standard picket 16 about the picket plugs 20. The interface of the walls 53 and channels 63 limit the rotational positions for picket installation. When the walls 53 interface with the channels 63 of the picket plug 20, a series of pickets 14, 16 may all be installed in a consistent and repeatable orientation. In some embodiments, the standard picket 16 or support picket 14 may have an appearance or outer profile that is not aesthetically dependent on a consistent orientation, for example circular.

In some embodiments, the standard picket 16 or support picket 14 can be made of such material to allow for the junction of the end of the picket 16, 14 and the picket-insertable portion of the picket plug 20 to have an interference fit. In other embodiments, the junction of the standard picket 16 or support picket 14 with the picket plug 20 may also be a cantilever snap-fit joint, an annular snap-fit joint, a torsional snap-fit joint, or any other assembly technique that minimizes the amount of excess tools that a user may be required to have available.

To make fabrication efficient, the standard picket 16 and the support picket 14 may be extruded to have the same profile and cut to length. The support picket 14 may be the same as the standard picket 16 with the exception of not including the threaded insert 28 or the through hole 15. The common profiles of the standard picket 16 and the support picket 14 allows a common picket plug 20 to be used for both picket types. Alternatively, the support picket end profile may be different from the standard picket end profile.

In some embodiments, a standard picket 16 is made of the same material as the rail member 10. In yet another embodiment, the standard picket 16 is made of the same material as the support picket 14, whereas in others, they are made of different materials or different types of materials.

Figure 6A:
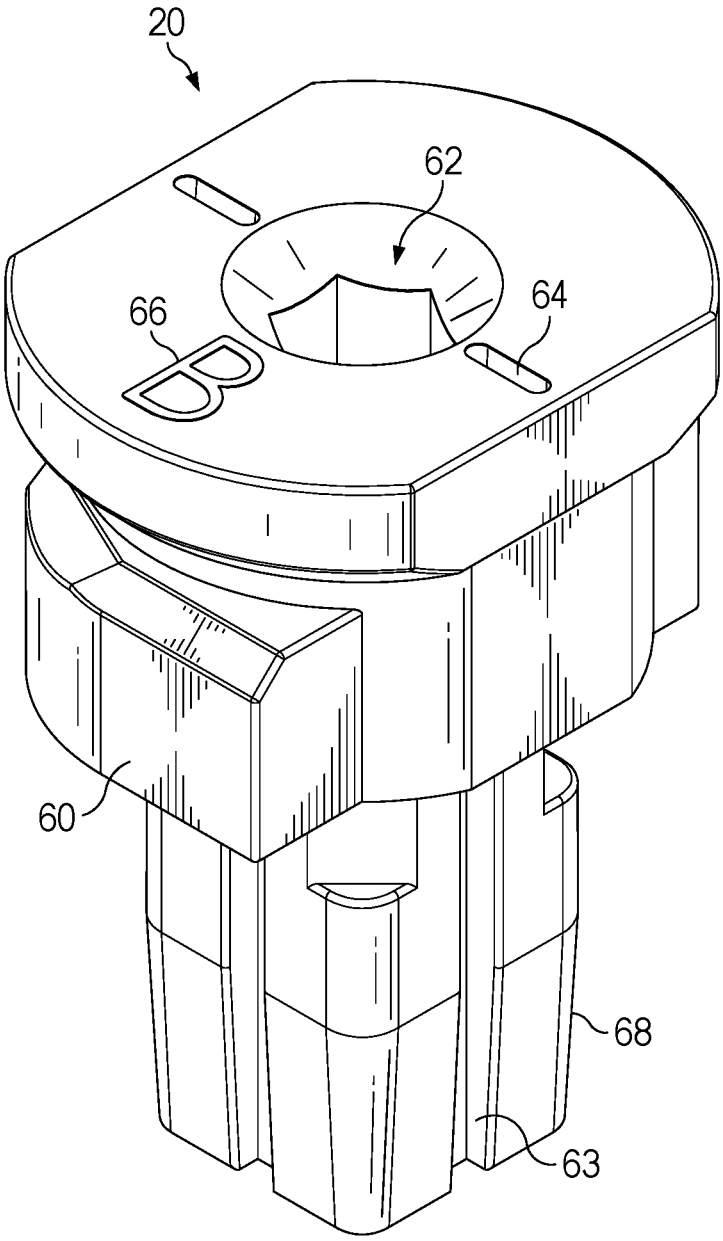
FIG. 6A is a perspective view of a picket plug and FIGS. 6B and 6C respectively are overhead, plan views and bottom views of the picket plug.
Figure 6B:
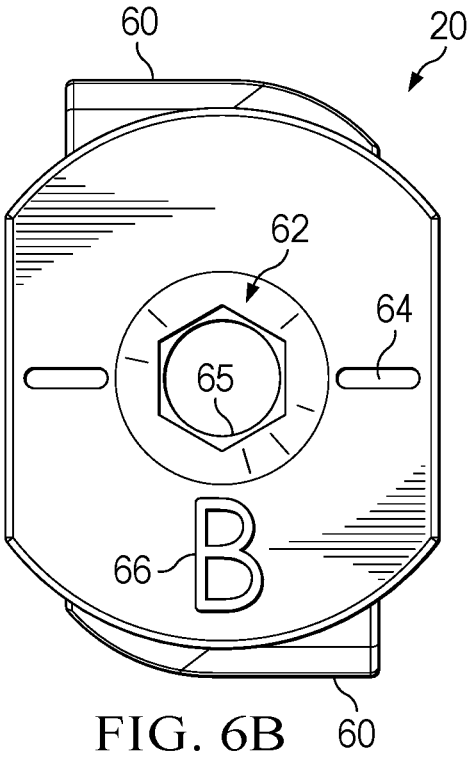
FIG. 6D is a top perspective view of a rail member with a pair of picket plugs, one in the free orientation and one in the locked orientation.
Figure 6C:
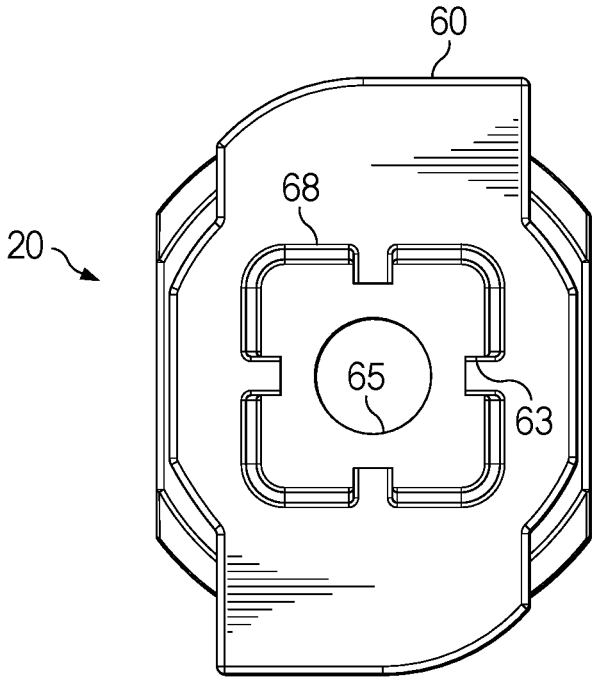

Reference is now made to FIGS. 6A, 6B, and 6C which respectively illustrate a perspective view, top view, and bottom view of an embodiment of a bottom picket plug 20. The bottom picket plug 20 and the top picket plug 18 (see FIGS. 1 and 3B) may be substantially identical with the exception of non-functional markings that may serve to identify and distinguish the top rail 10 from the bottom rail 12. The picket plug 20 has a pair of locking lugs 60, a keyed access feature 62, orientation indicators 64, and a picket-insertable portion 68 that includes a plurality of channels 63 running the length of the picket-insertable portion 68. Optionally, the top or bottom picket plugs 18, 20 can have a specific rail indicators 66, as illustrated in the embodiment as a "B" for "bottom rail." The specific rail indicator 66 can however follow any indication scheme selected by a manufacturer to aid in the assembly of the rail panel 100.

In this embodiment, the bottom picket plug 20 includes a pair of locking lugs 60. The locking lugs 60 extend from a body of the picket plug 20 such that when the picket plug 20 is in the free or insertable orientation, the picket plug 20 may be inserted into or removed from a rail member 10, 12. Once inserted into the rail 10, the picket plug 20 can be rotated a quarter turn to the locked orientation, such that the picket plug 20 is secured within the rail member 10, 12 in that the locking lugs 60 are positioned between the locking ledges 36 and the transverse wall 30 within the open channel 17. Once rotated into the locked orientation, the locking lugs 60 engage or interlock with the locking ledges 36, to secure the picket plug 20 to the rail member 10.

In the present embodiment, the keyed access feature 62 is illustrated such to accept a male hex shaped tool. However, the keyed access feature 62 is capable of being any kind of structure that enables a user to rotate the top picket plug 18 within the rail 10, preferably with a tool. Such structures include but are not limited to a male hex bolt head, a slot or pair of slots for a flathead or Philips head screwdriver, a cube shaped hole or lug, a star shaped hole or lug, or any other type of head that can be utilized with a tool that facilitates the quarter turn rotation of the picket plug 20.

In the present embodiment, the keyed access feature 62 also corresponds to a through hole 65 to receive a fastener when the picket plug 20 is used to secure a support picket to the top rail or the bottom rail 12. The purpose of through hole 65 is such that the fastener 22 utilized for the support picket 14 can be received through the picket plug 20. In certain embodiments, the through hole 65 may be advantageously collocated with the keyed access feature 62. The through hole may be countersunk to allow the head of the fastener 22 to sit substantially flush with the top surface of the picket plug 20. Also, the same picket plug 20 may be used with either a standard picket 16 or a support picket 14, depending on whether the particular picket plug 20 also receives a fastener through the through hole 65. In other embodiments, the keyed access feature 62 may be a blind hole, a countersunk hole, a counter-bored hole, or any other type of hole or recess that would allow for the keyed access feature 62 to operate to rotate the picket plug one quarter turn to lock it to the top rail or the bottom rail, as previously described.

Figure 6D:
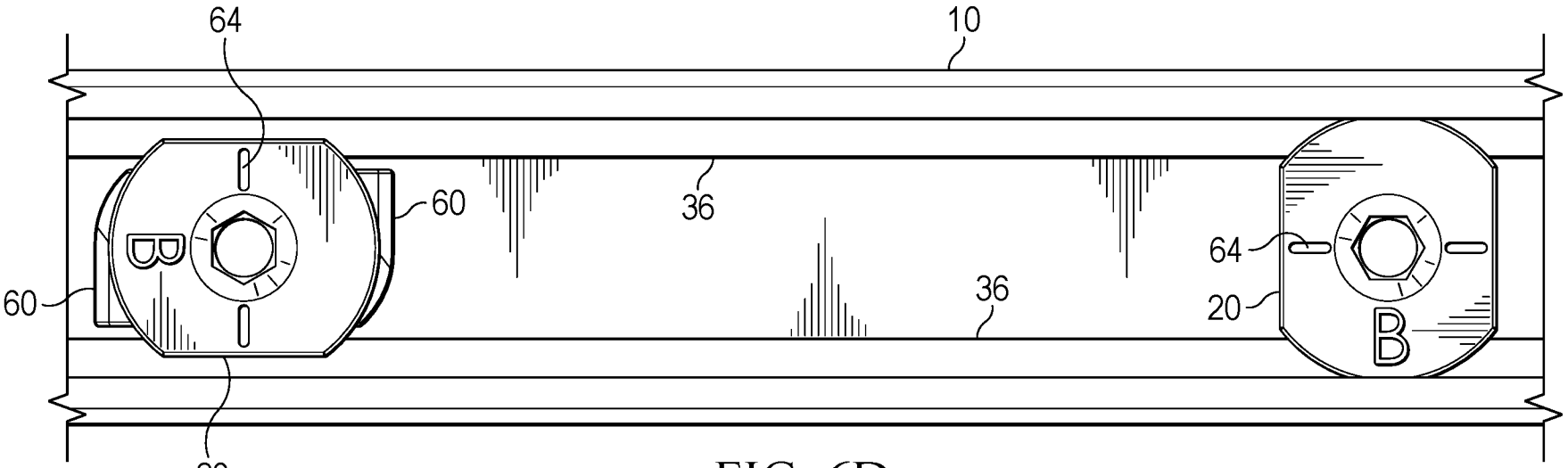

FIG. 6D is a top perspective view of a rail member with a pair of picket plugs, one in the free orientation and one in the locked orientation. The orientation indicators 64 are such that a user can quickly identify whether or not the picket plug 20 is in a locked orientation or in a free orientation by identifying whether the orientation indicators 64 are aligned with the longitudinal axis of the rail 10, 12 or are oriented perpendicular to the longitudinal axis of the rail 10, 12. The ability to identify the orientation of a picket plug 20 aids the user in being able to quickly and accurately assemble the rail panel 100. If the orientation indicators 64 of each picket plug 20 are aligned with each other, the user can be confident that all of the picket plugs 20 have been rotated into locking engagement with the rail 10, 12. Furthermore, the locking lugs 60 can be seen in the free orientation for one picket plug 20 and cannot be seen on the picket plug 20 in the locked orientation. The locking lugs 60 cannot be seen on the picket plug 20 in the locked orientation because the locking lugs 60 are engaged with and concealed by the locking ledges 36.

In some embodiments, some components are identical between the top and bottom picket plug 18, 20, such that there is no difference between the top picket plug 18 and the bottom picket plug 20. In another embodiment, the differences are such that the top picket plug 18 and the bottom picket plug 20 are not interchangeable at all. Such differences may include the bottom picket plug being thicker than the top picket plug 18.

Figure 7A:
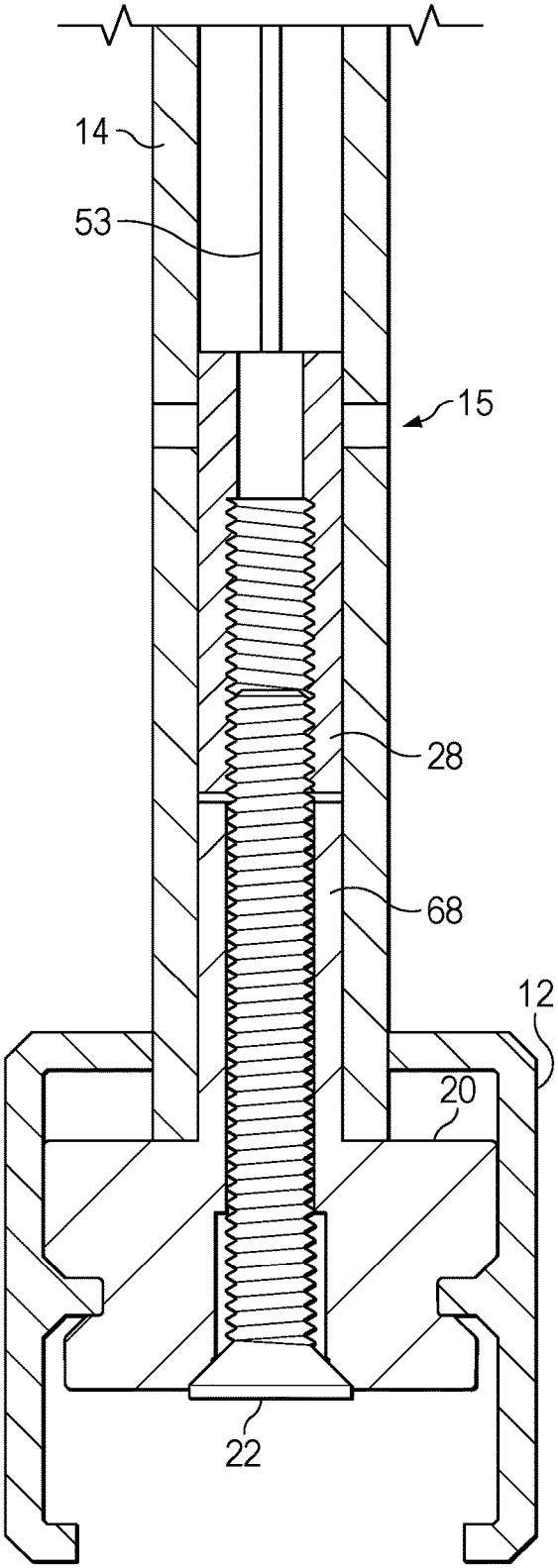
FIGS. 7A, 7B, and 7C are cross-sectional views respectively of a support picket coupled to a bottom rail, a standard picket coupled to a bottom rail, and a support picket coupled to the top rail with a rail cap.

Reference is now made to FIG. 7A, which is a cross section showing the engagement of a bottom picket plug 20 with a support picket 14. As described in more detail above, the picket plug is inserted into the bottom rail 12 and rotated one-quarter turn such that the locking lugs 60 engage the locking ledges 36. The picket-insertable portion 68 of the picket plug 20 is received in the generally hollow end of the support picket 14 and the walls 53 are engaged with the channels 63 formed in the picket plug 20. The fastener 22 is received through the through hole 65 in the picket plug 20 and is in threaded engagement with the threaded insert 28 of the support picket 14. The support picket 14 bears on one end against the bottom picket plug 20 and at an opposite end on the top picket plug 18 due to the threaded fastener 22 fastening the bottom picket plug 20 to the support picket 14 and a second threaded fastener 22 fastening the top picket plug 18 to the opposite end of the support picket 14 (not shown).

Figure 7B:
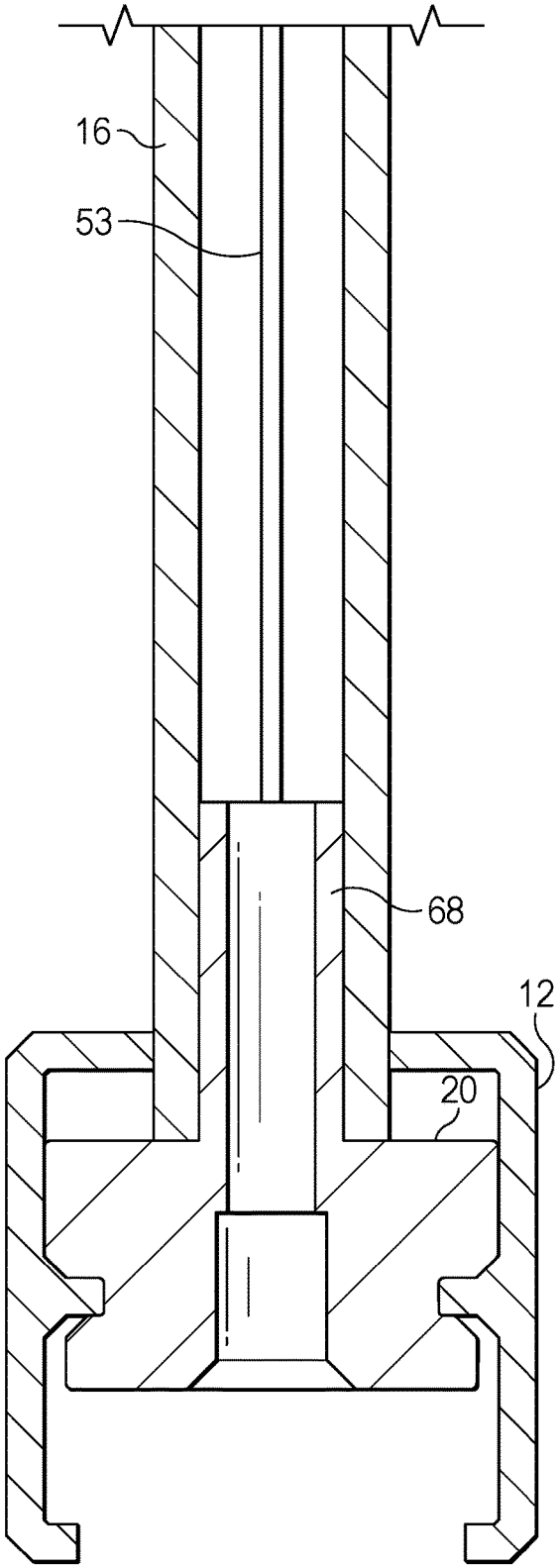
Figure 7C:
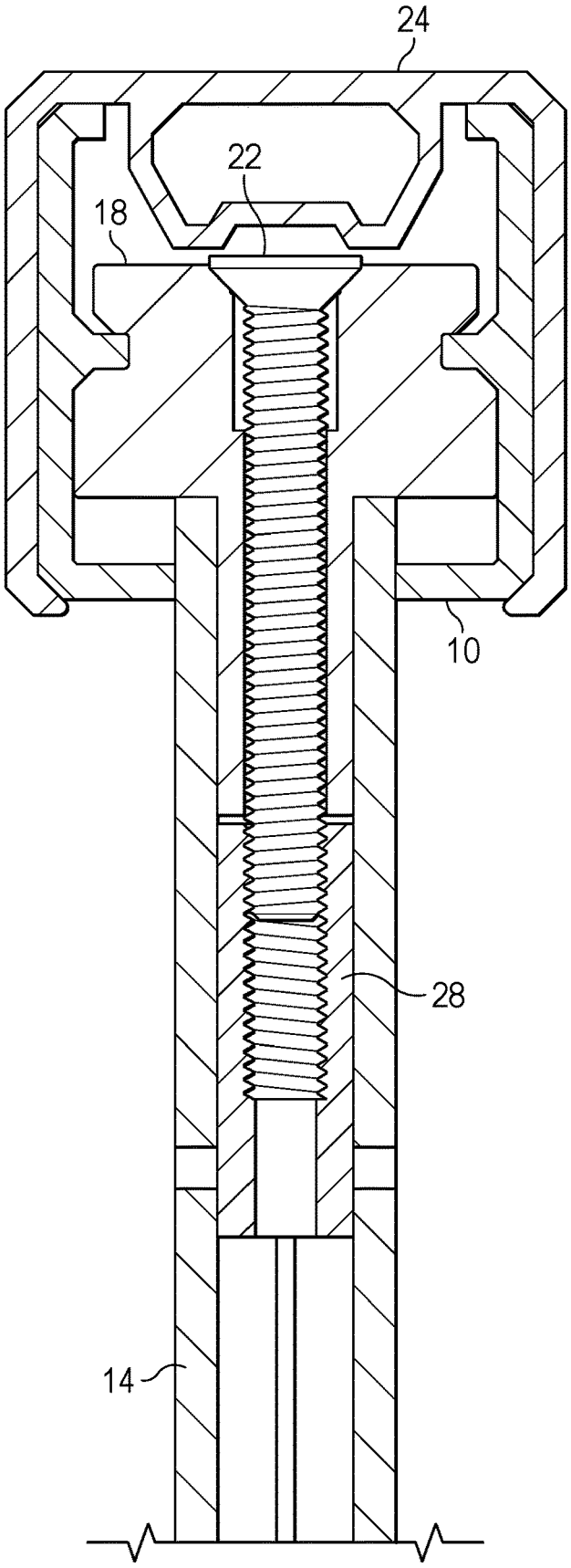

FIG. 7B is a cross section showing the engagement of the picket plug 20 with a standard picket 16. The picket-insertable portion 68 of the picket plug 20 is received in the generally hollow end of the standard picket 16 and the walls 53 are engaged with the channels 63 formed in the picket plug 20. The standard picket 16 is retained between the top rail 10 and the bottom rail 12 by the coupling of the bottom rail 12 to the top rail 10 through the support pickets 14. The standard picket 16 bears on one end against the bottom picket plug 20 and at an opposite end bears on the top picket plug 18. Although the bottom engagement of the bottom picket plug 20 with the standard picket 16 does not include a threaded fastener, the joining of the top rail 10 with the bottom rail through one or more of the support pickets 14 and threaded fasteners maintains engagement of the standard picket 16 with the picket plugs 18, 20 at each end of the support picket 14.

In the illustrated embodiment, portions of the standard picket 16 and the support picket 14 are received in their respective clearance openings 40. The clearance openings 40, the pickets 14, 16, and the picket-insertable portions 68 of the picket plugs 20 are sized and shaped such that a clearance is formed around the picket-insertable portion 68 of the picket plug 20 and the walls of the opening 40. Alternatively, the sizes of the opening 40 and the picket (support picket 14 or the standard picket 16) may be such that the picket 14, 16 is not received in the opening 40, and therefore is outside of the bottom rail 12. In this embodiment, each end of the standard picket 16 and the support picket 14 bear on the top rail 10 and the bottom rail 12, as opposed to the top and bottom picket plugs 18, 20.

FIG. 7C is a cross-sectional view of the assembly of the rail cap 24 with the top rail 10 at the location of a top picket plug 18 that is secured to a support picket 14 with a fastener 22. The assembly of the top rail 10 with the standard pickets 16 and the support pickets 14 is the same as described above and shown in FIGS. 7A and 7B with respect to the bottom rail 12.

Figure 8:
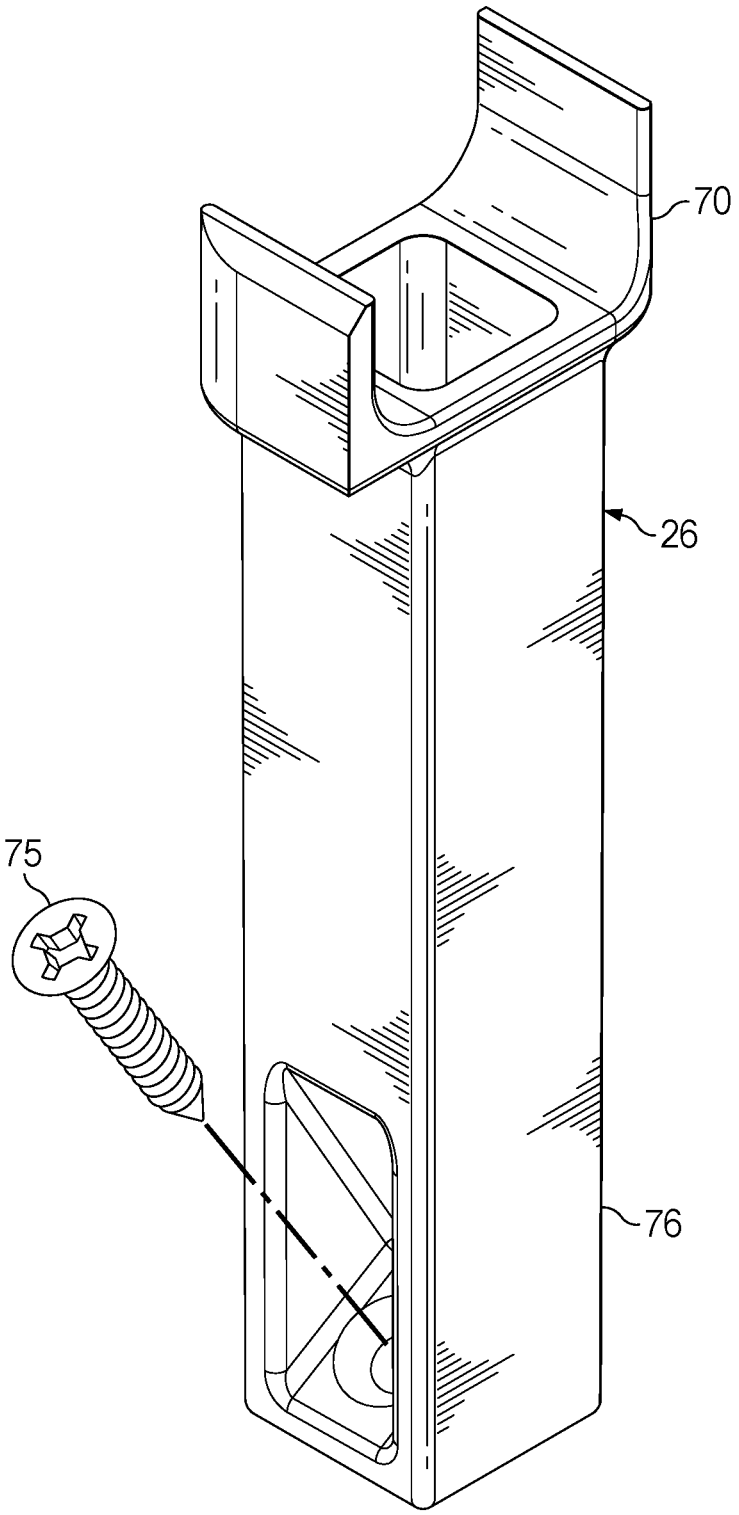
FIG. 8 is a perspective view of a support member configured to couple to the bottom rail.

Reference is now made to FIG. 8, which illustrates an embodiment of a support member 26. The support member 26 can be added to a rail panel 100 assembly to aid in carrying the weight of the rail panel 100 and any weight carried by the rail panel (e.g. a person sitting or standing on the rail panel) in areas that lack support, such as near the center of the rail panel 100. The support member 26 can have locking lugs 70 that can interlock with locking ledges 36. The locking lugs 70 of the support member 26 allow the support member 26 to be installed in a rail in the same manner in which the picket plugs are installed. Where the support member 26 is inserted into the rail in one orientation, then rotated one-quarter turn into a locked orientation. This installation method aids in a user's ability to assemble the rail panel 100 with minimal tools. In other embodiments, the support member 26 does have locking lugs 70, but is configured to be attached to the bottom rail 12 with the use of fasteners 74. Once the rail panel 100 is in its intended installation position, a fastener 75 can be utilized to secure the support member 26 to the flooring, such as wooden or composite deck boards.

Figure 9A:
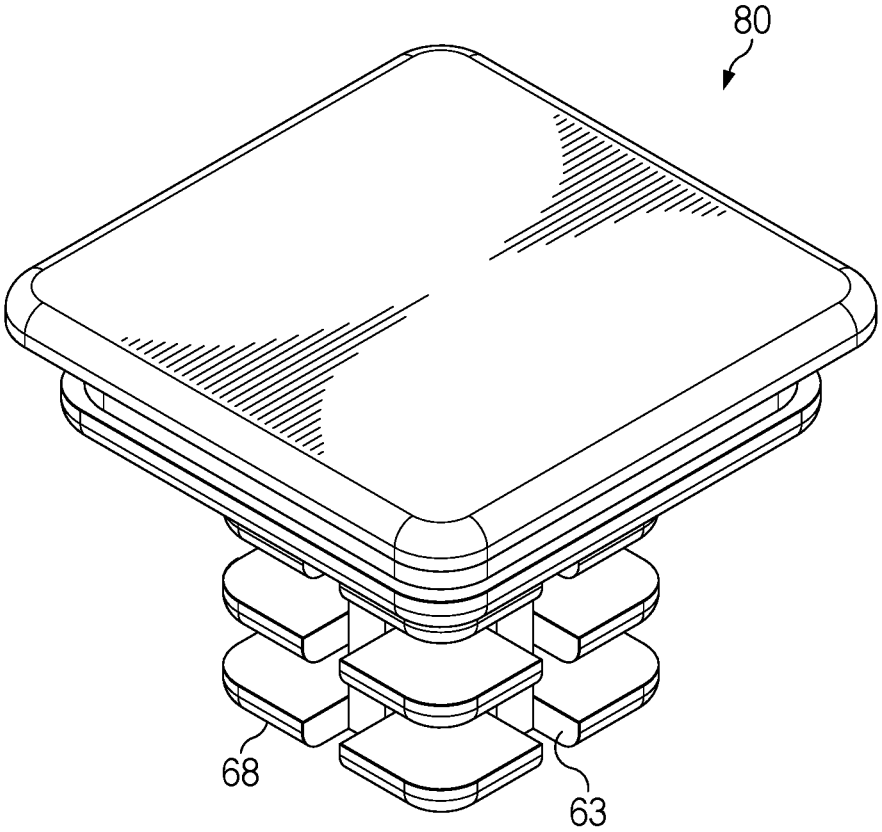
FIGS. 9A and 9B are respectively a perspective view of an alternate embodiment of a picket plug and an end view of the picket plug of FIG. 9A coupled to a rail member.
Figure 9B:
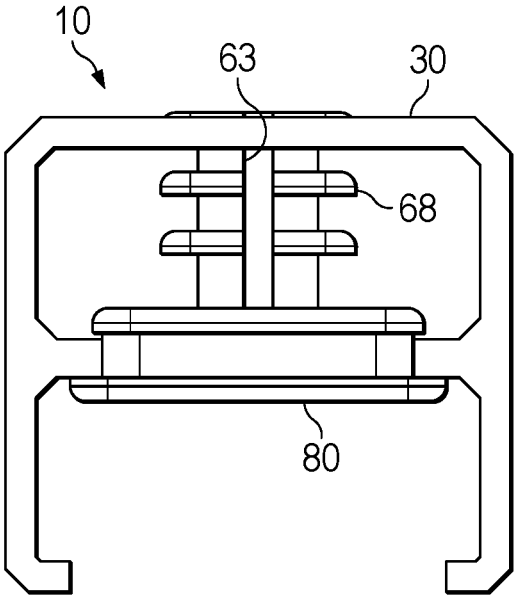

Referring now to FIGS. 9A and 9B, which illustrates an alternative embodiment of a picket plug 80. In this embodiment, the picket plug 80 retains the channels 63, and is structured such that the end profile is a plurality of outwardly extending fins 68 that create an interference fit when the picket is inserted over it. In the present embodiment, the picket plug 80 is installed to the rail by snapping it into place. Internal features of the respective rail 10, 12 may be sized and shaped to engage with corresponding features of the picket plug 80 to allow it to snap in place such that a portion of the picket plug 80 is received in the clearance opening 40 (see FIG. 2A) in the transverse wall 30 of the rail 10, 12.

Figure 10:
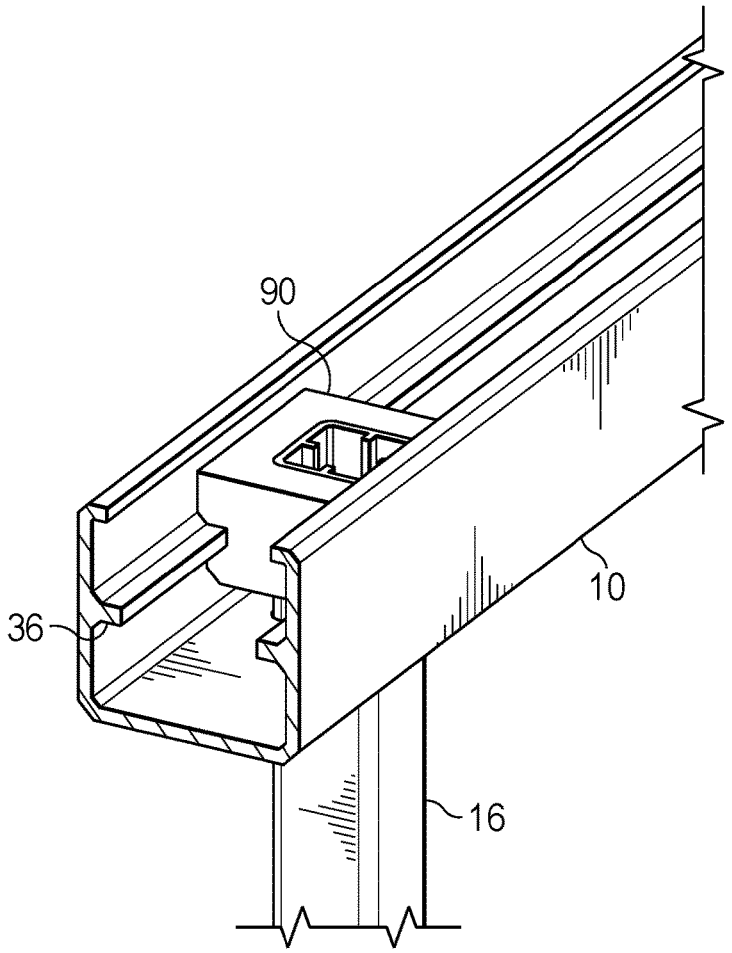
FIG. 10 is a perspective view of another alternate embodiment of a picket plug coupled to a rail member.

Referring now to FIG. 10, which illustrates another embodiment of a picket plug 90. In this embodiment, a standard picket 16 is inserted through the plurality of clearance openings 40 (see FIG. 2A) and through the picket plug 90. The picket 16 is inserted through the picket plug 90 and the picket is secured by friction along the external surface of the picket 16 created by an interference fit with the picket plug 90. The picket plug 90 can deform, plastically or elastically, around the external surface of the standard picket 16 such that the standard picket 16 is held securely in place. This embodiment similarly does not require a user to install the picket plug 90 in one orientation and then rotate to another, but rather is installed by sliding the picket plug 90 down one of end of the rails.

Figure 11:
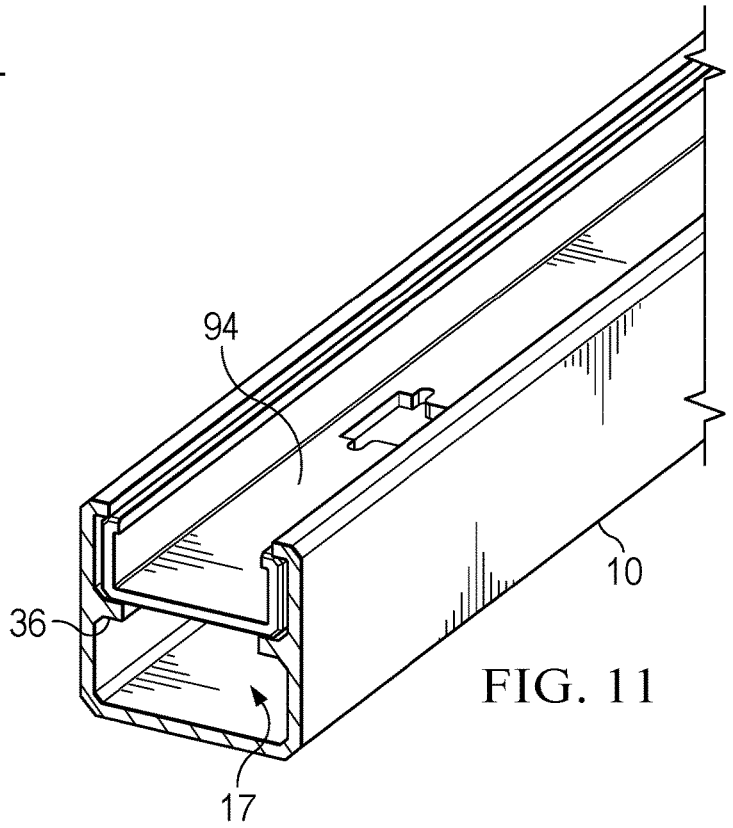
FIG. 11 is a perspective view of yet another alternative embodiment of rail assembly to which a picket may be coupled.

Reference is now made to FIG. 11, which illustrates yet another embodiment of a picket retention feature. In this embodiment, the picket 16 is inserted through a hole in an inner transverse wall 94 disposed in the open channel 17 in the rail 10, 12. The inner transverse wall 94 may be formed of materials such that a pair of tabs is resilient. The inner transverse wall including the resilient tabs is analogous to the picket plugs of the other disclosed embodiments. The hole in the inner transverse wall 94 is sized such that insertion of the picket through the hole displaces the tabs elastically. A hole in the picket will align with the tabs and tabs will return to their natural, non-displaced position due to the resilience of the material of the tabs upon alignment with a pair of holes formed in the walls of the picket.

According to an alternate embodiment, the tabs are not received in holes or depressions in the picket, but rather create an interference fit to hold the standard picket 16 in place. The embodiment shown in FIG. 11 does not require a user to install the picket plug 20 in one orientation and then rotate to another, but rather is installed by sliding the inner transverse wall 94 down one of end of the rails.

A method of assembly of a rail panel 100 begins in some embodiments with first inserting the picket plugs 20 into their position in the bottom rail 12 in the free orientation. Then aligning the picket plugs 20 with the plurality of spaced apart clearance openings 40. Then, rotating the picket plugs 20 into the locked orientation. Next, fitting the support pickets 14 over their designated picket plugs 20 by inserting the support picket 14 through their respective spaced apart clearance openings 40 and aligning the inwardly extending walls 53 of the picket with the channels 63 of the picket plugs 20. Subsequently, the fastener 22 is installed through the picket plug 20 and threaded it into the insert 28. Next, the standard pickets 16 are fit over the remaining picket plugs by inserting the standard pickets 16 through their respective spaced apart clearance openings aligning the inwardly extending walls 53 of the pickets with the channels 63 of the picket plugs 20.

Afterwards, the picket plugs 18 are installed in the top rail 10 first by inserting them into rail 10 in the free orientation, aligning them with the plurality of spaced apart clearance openings 40, then rotating the into the locked orientation. The top rail 10 is then aligned with the bottom rail 12, such that the picket plugs 18 of the top rail are aligned with the respective standard pickets 16 and support pickets 14. The top rail 10 is then moved down such that the standard pickets 16 and support pickets 14 interface with the picket plugs 18 such that the channels 63 of the picket plugs 18 engage with the inwardly extending walls 53 of the pickets. The fastener 22 is then inserted through the picket plugs 18 associated with the support pickets 14, and then threaded into the insert 28. The rail cap 24 is then slid over the top rail 10 such that the picket plugs 18 are concealed.

Although embodiments of the rail panel system 100 have been described in detail, those skilled in the art will also recognize that various substitutions and modifications may be made without departing from the scope and spirit of the appended claims.

According to an embodiment, the user assemblable rail panel 100 may be provide as a knock-down panel. In this embodiment, the installer may receive a kit or box with unassembled components. The unassembled components may be easier to ship and store than an assembled rail panel 100. The knock-down user assemblable rail panel 100 may be shipped with the top rail 10, support pickets 14, standard pickets 16, and the bottom rail 12 separate from each other. The top picket plugs 18 may be installed in the top rail 10 and the bottom picket plugs 20 may be installed in the bottom rail 12 or they too may be shipped separate.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A rail panel, comprising:

a top rail comprising a transverse wall, a first side wall and a second side wall each extending from the transverse wall, the transverse wall defining a plurality of openings disposed spaced apart along a length of the transverse wall, the top rail further comprising a first locking ledge extending from a first side wall and a second locking ledge extending from the second side wall;

a picket plug configured to be secured to the top rail by the first and second locking ledges and having a picket-insertable portion configured to be aligned with one of the plurality of openings in the transverse wall, the picket plug defining a through hole configured to receive a fastener;

a support picket configured to receive the picket-insertable portion of the picket plug and comprising a threaded hole configured to receive the fastener;

a bottom rail configured to be coupled to the support picket; and a plurality of infill pickets configured to be coupled to the top rail and the bottom rail.

2. The rail panel of claim 1 wherein the picket plug further comprises a pair of locking lugs configured to engage the first and second locking ledges in a first orientation and configured to clear the first and second locking ledges in a second orientation.

3. The rail panel of claim 2 wherein the locking lugs are configured such that the picket plug can be rotated one-quarter turn from the first orientation to the second orientation.

4. The rail panel of claim 1 wherein the picket-insertable portion of the picket plug defines a channel and the support picket comprises an inwardly extending wall configured to be received by the channel.

5. The rail panel of claim 1 wherein the support picket includes a threaded member welded within the support picket, the threaded member defining the threaded hole.

6. The rail panel of claim 1 wherein the top rail, the bottom rail, the support picket, and the plurality of infill pickets are each formed of aluminum.

7. The rail panel of claim 1 wherein the top rail, the bottom rail, the support picket, and the plurality of infill pickets are each formed by extruding a material.

8. The rail panel of claim 1 wherein the top rail, the bottom rail, the support picket, and the plurality of infill pickets are each formed by extruding a metal.

9. The rail panel of claim 1 further comprising a rail cap configured to couple to the top rail.

10. The rail panel of claim 1 wherein the picket-insertable portion is received through the one of the plurality of openings.

11. The rail panel of claim 10 wherein the picket-insertable portion and the openings are sized and shaped to form a clearance configured to receive a portion of the support picket.

12. The rail panel of claim 1 wherein a first end of the support picket is configured to bear on the transverse wall of the top rail and a second end of the support picket opposite the first end is configured to bear on the bottom rail.

13. A rail panel, comprising:

a top rail comprising a transverse wall, a first side wall and a second side wall each extending from the transverse wall, the transverse wall defining a plurality of openings disposed spaced apart along a length of the transverse wall, the top rail further comprising a first locking ledge extending from a first side wall and a second locking ledge extending from the second side wall;

a plurality of first picket plugs each secured to the top rail by the first and second locking ledges and having a picket-insertable portion configured to be aligned with respective ones of the plurality of openings in the transverse wall;

a second picket plug secured to the top rail by the first and second locking ledges and having a picket-insertable portion configured to be aligned with one of the plurality of openings in the transverse wall, the second picket plug defining a through hole configured to receive a fastener;

a plurality of standard pickets each configured to receive the picket-insertable portion of respective ones of the plurality of first picket plugs;

at least one support picket configured to receive the picket-insertable portion of the second picket plug and comprising a threaded hole configured to receive the fastener; and a bottom rail configured to be coupled to the plurality of standard pickets and the support picket.

14. The rail panel of claim 13 wherein the plurality of first picket plugs and the second picket plug each further comprises a pair of locking lugs engaged with the first and second locking ledges in a first orientation and configured to clear the first and second locking ledges in a second orientation.

15. The rail panel of claim 14 wherein the locking lugs are configured to be rotated one-quarter turn from the first orientation to the second orientation.

16. The rail panel of claim 13 wherein:

the picket-insertable portions of the plurality of first picket plugs define a channel and the plurality of standard pickets each comprises an inwardly extending wall configured to be received by the channel of respective ones of the first picket plugs; and the picket-insertable portion of the second picket plug defines a channel and the support picket comprises an inwardly extending wall configured to be received by the channel of the second picket plug.

17. A rail panel, comprising:

a first support post supporting first ends of a top rail and a bottom rail, a second support post supporting second ends of the top rail and the bottom rail opposite the first ends;

the top rail comprising a transverse wall, a first side wall and a second side wall each extending from the transverse wall, the transverse wall defining a plurality of openings disposed spaced apart along a length of the transverse wall, the top rail further comprising a first locking ledge extending from a first side wall and a second locking ledge extending from the second side wall;

a plurality of first picket plugs each secured to the top rail by the first and second locking ledges and having a picket-insertable portion extending through respective ones of the plurality of openings in the transverse wall, a second picket plug secured to the top rail by the first and second locking ledges and having a picket-insertable portion extending through one of the plurality of openings in the transverse wall, the second picket plug defining a through hole;

a plurality of standard pickets each receiving the picket-insertable portion of respective ones of the plurality of first picket plugs;

at least one support picket receiving the picket-insertable portion of the second picket plug and comprising a threaded hole;

a fastener received through the through hole in the second picket plug and in threaded engagement with the threaded hole of the at least one support picket; and a bottom rail coupled to the plurality of standard pickets and the support picket.

18. The rail panel of claim 17 wherein the support picket includes a threaded member in welded within the support picket, the threaded member defining the threaded hole.

19. The rail panel of claim 17 wherein the top rail, the bottom rail, the plurality of standard pickets, and the support picket are each formed of aluminum.

20. The rail panel of claim 17 wherein the top rail, the bottom rail, the plurality of standard pickets, and the support picket are each formed by extruding a metal.

* * * * *